US009290875B2

(12) United States Patent
Fogg

(10) Patent No.: US 9,290,875 B2
(45) Date of Patent: Mar. 22, 2016

(54) GARMENT STRETCHING APPARATUS

(71) Applicant: Justina Paige Fogg, Springdale, AR (US)

(72) Inventor: Justina Paige Fogg, Springdale, AR (US)

( * ) Notice: Subject to any disclaimer, the term of this patent is extended or adjusted under 35 U.S.C. 154(b) by 0 days.

(21) Appl. No.: 14/319,120

(22) Filed: Jun. 30, 2014

(65) Prior Publication Data

US 2015/0376826 A1 Dec. 31, 2015

(51) Int. Cl.

*D06C 15/00* (2006.01)
*D06C 3/08* (2006.01)
*A47G 25/62* (2006.01)

(52) U.S. Cl.

CPC . *D06C 3/08* (2013.01); *A47G 25/62* (2013.01)

(58) Field of Classification Search

CPC ..... A47G 25/62; A47G 25/621–25/629; A47G 25/66; A47G 25/68; A47G 25/70; A47G 25/76; A47G 25/1442; A47G 25/145; A47G 25/0614; A47G 25/0657

USPC ..... 223/61, 63, 65, 69, 96

See application file for complete search history.

(56) References Cited

U.S. PATENT DOCUMENTS

| | | | | | |
|---|---|---|---|---|---|
| 1,390,054 | A * | 9/1921 | McNeely | 38/70 |
| 1,579,385 | A * | 4/1926 | Nelson | 38/102.4 |
| 1,856,064 | A * | 5/1932 | Alexander | 38/102.4 |
| 3,790,043 | A * | 2/1974 | Hagen | 223/61 |
| 4,846,430 | A * | 7/1989 | Ke | 248/215 |
| 5,595,331 | A * | 1/1997 | Leistner | 223/91 |
| 6,158,593 | A * | 12/2000 | Olsen | 211/14 |
| 6,223,910 | B1 * | 5/2001 | Levin et al. | 211/30 |
| 7,810,654 | B1 * | 10/2010 | Wang | 211/106.01 |
| 2005/0109802 | A1 * | 5/2005 | Avery et al. | 223/85 |
| 2009/0188954 | A1 * | 7/2009 | Mangano | 223/93 |
| 2010/0181351 | A1 * | 7/2010 | Kirschbaum | 223/96 |

FOREIGN PATENT DOCUMENTS

| | | | | |
|---|---|---|---|---|
| DE | 328366 C | * | 10/1920 | A47G 25/62 |
| DE | 19938013 A1 | * | 1/2000 | A41H 43/00 |

* cited by examiner

*Primary Examiner* — Nathan Durham

(57) ABSTRACT

A garment stretching apparatus includes a strap with an attached bracket at each end to securely fasten the strap on the desired vertical upright and a pair of clamps to secure the garment during the stretching process. The strap includes a plurality of apertures evenly spaced. Each clamp connects to the strap at the aperture selected by the user.

3 Claims, 6 Drawing Sheets

FIG. 7
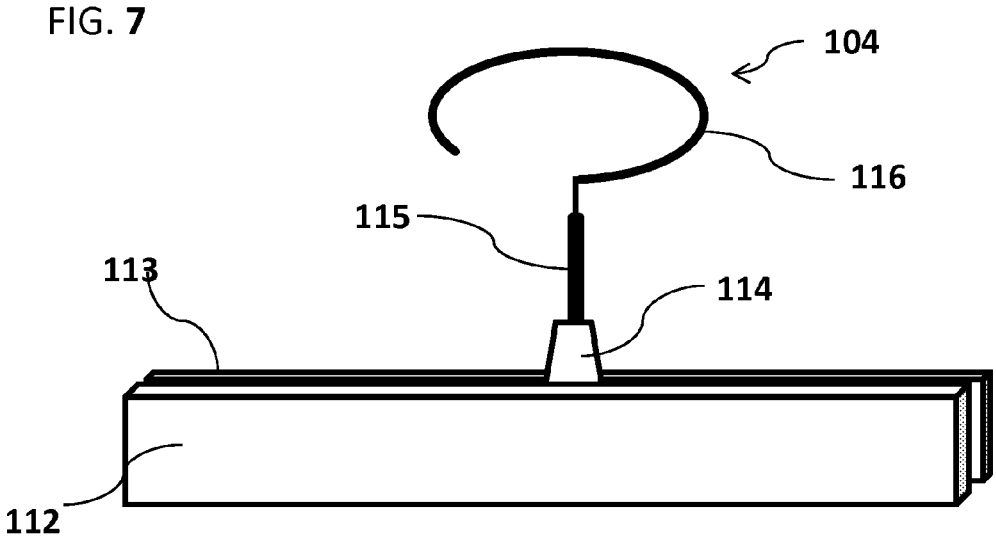
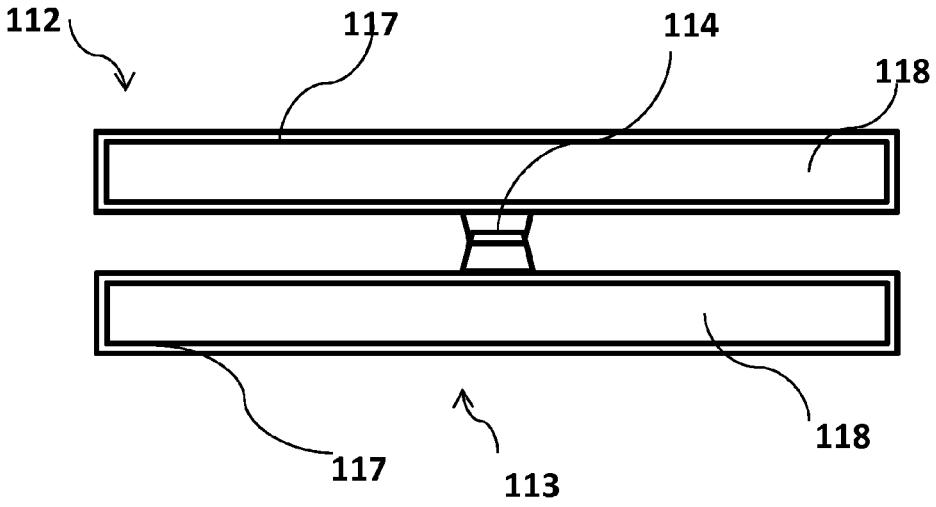
FIG. 8

GARMENT STRETCHING APPARATUS

The statements in this section merely provide background information related to the present disclosure and may not constitute prior art.

BACKGROUND

1. Field of the Invention

The present disclosure relates to a garment stretching apparatus.

2. Description of the Related Art

There are a number of garment stretching apparatus that are designed to stretch various articles of clothing; specifically, those articles of clothing that are made of fabric. Generally, the various garment stretching apparatus focus on a specific article of clothing, such as shirts or blouses or on a specific aspect of a clothing article such as a shirt collar or a waist band of a skirt. Commonly the garment stretching apparatus comprises several sections that are mechanically adjusted to achieve a pre-set stretching amount. Typically, the various garment stretching apparatus are overly complicated and not user friendly. The present garment stretching apparatus has fewer and simpler parts resulting in a user friendly garment stretching apparatus. Additionally, the present garment stretching apparatus provides the user with the flexibility in selecting the desired amount of stretching, is economical to make, easily stored between uses, and may be used with numerous types of garment.

SUMMARY

The inventor hereof has succeeded at designing a garment stretching apparatus which provide the user the ability to select the amount of stretching and may be used to stretch various types of garments. Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

FIG. 7 is a perspective view of clamp; and

FIG. 8 is a perspective view of an opened clamp with a pair of flats.

DETAILED DESCRIPTION

The following description is merely exemplary in nature and is not intended to limit the present disclosure or the disclosure's applications or uses.

Figure 4:
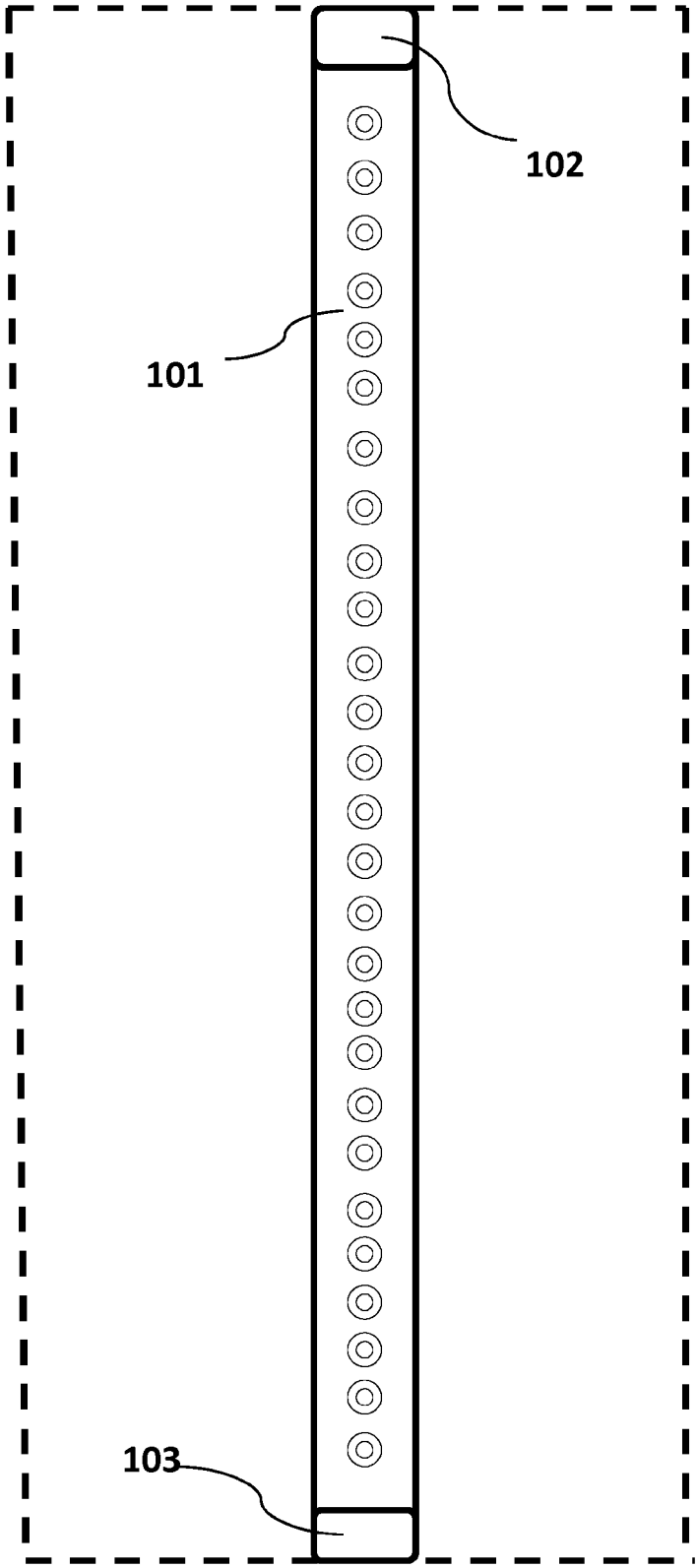
FIG. 4 is an illustrative view of a strap with brackets positioned on a door.
Figure 5:
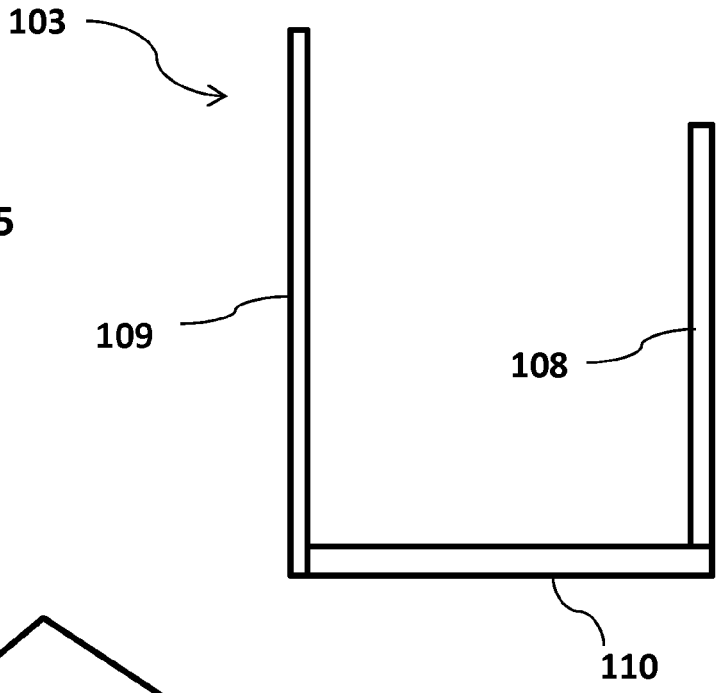
FIG. 5 is a side view of a bracket.
Figure 6:
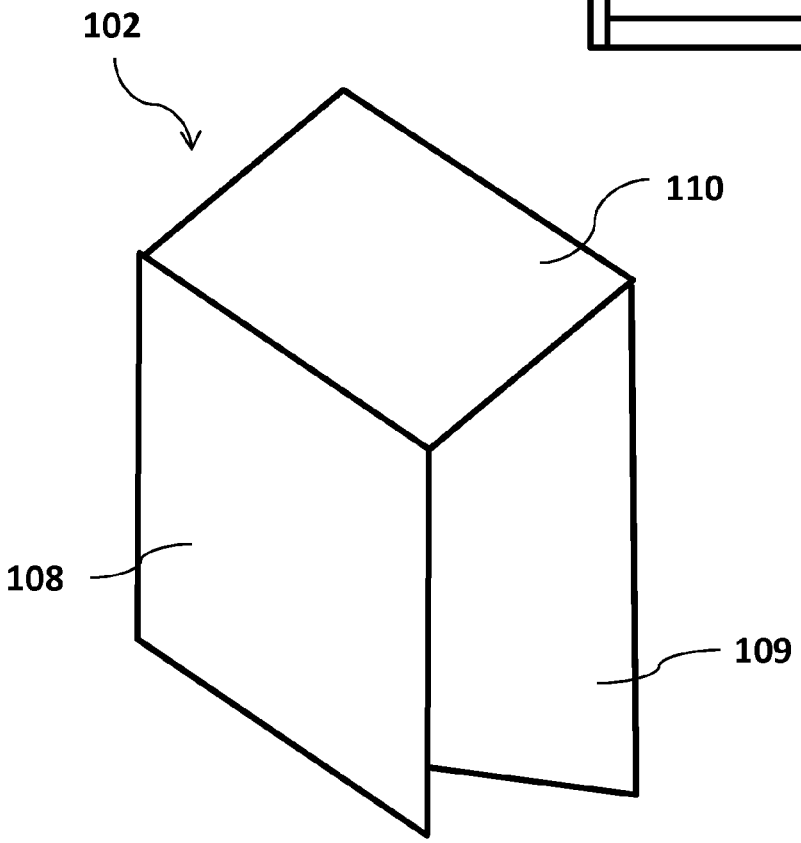
FIG. 6 is a perspective view of a bracket.

In FIGS. 1 through 8, an exemplary embodiment of a garment stretching apparatus 100 is shown. Garment stretching apparatus 100 comprises a strap 101, a top bracket 102, a bottom bracket 103, and a pair of clamps, 104, 105. As shown in FIGS. 5 and 6, the top bracket 102 and the bottom bracket 103 are U shaped and are intended to fit tightly on the top edge of the vertical support, such as a door, and each bracket 102, 103 is connected at each end, first end 106 and second end 107, of the strap 101. Each bracket 102, 103 includes three flat sides, with a front side 108, a back side 109 and a third side 110. The brackets 102, 103 may be made of different materials such as plastic or metal. In the present embodiment, the joining of the U shaped bracket 102, 103 to the strap 101 is made during the molding process of the U shaped bracket 102, 103; the U shaped bracket 102, 103 may also be attached by sewing or other means of fastening. The strap 101 may be made of nylon materials and the length of the strap 101 with the top bracket 102 and bottom bracket 103 attached must equal to the length of the intended vertical support (door) in order for the brackets to be stable during the stretching process as shown in FIG. 4. The third side 110 of the top bracket 102 rests on top of the vertical support and the third side 110 of the bottom bracket 103 is below and flushed against the bottom of the vertical support. The length of the strap 101 with brackets 102, 103 may vary and is contingent upon the length of the vertical support on which the U shaped brackets 102, 103 are secured. As shown in FIGS. 1-4, the strap 101 includes a plurality of apertures 111 that may be generated through the use of grommets. The apertures 111 are located along the horizontal center of the strap and are spaced evenly, one above the other.

As shown in FIGS. 7 and 8, each clamp 104, 105 consists of a pair of flats 112, 113, a clamp mechanism 114, an elastic device 115 and a hook 116. The clamp mechanism 114 which when folded downward opens the clamp 104, 105 to enable the user in placing the garment in between the flats, 112, 113. An inner side 117 of each flat 112, 113 is lined with a strip of material 118 for added grip. The strip of material 118 is fastened to the inner side 117 of each flat 112, 113 by adhesive or other similar materials. Referring back to FIG. 7, the clamp mechanism 114 is attached to the flats 112, 113 and between the clamp mechanism 114 and the hook 116, the elastic device 115 is positioned. The elastic device 115, such as a spring or a coil, provides the tension and extension needed during the stretching process. The elastic device 115 is fastened to the hook 116 and the clamp mechanism 114 by a soldering process or other fastening means. Other types of clamps with the elastic device 115 may be used for holding the garment or fabric during the stretching process.

Figure 1:
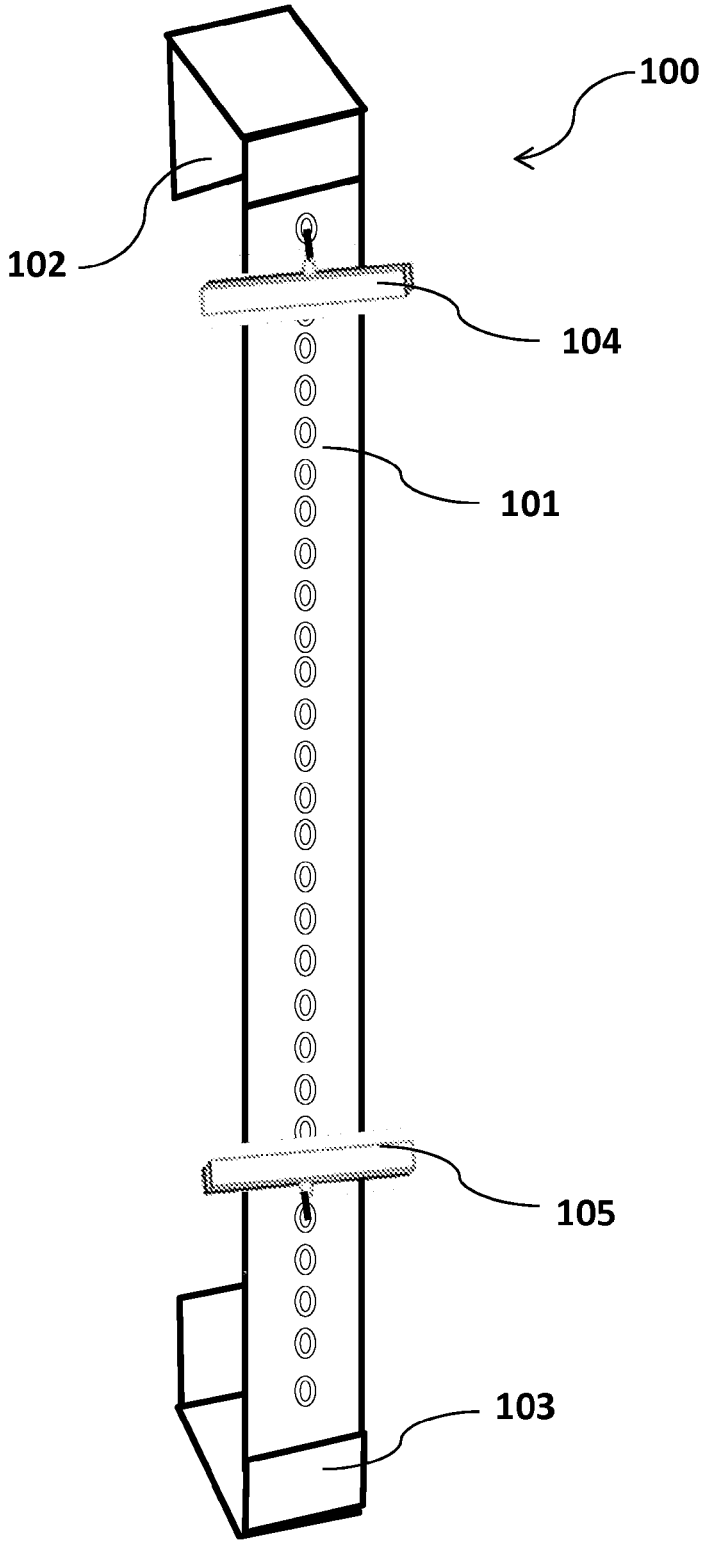
FIG. 1 is a perspective view of a garment stretching apparatus.
Figure 2:
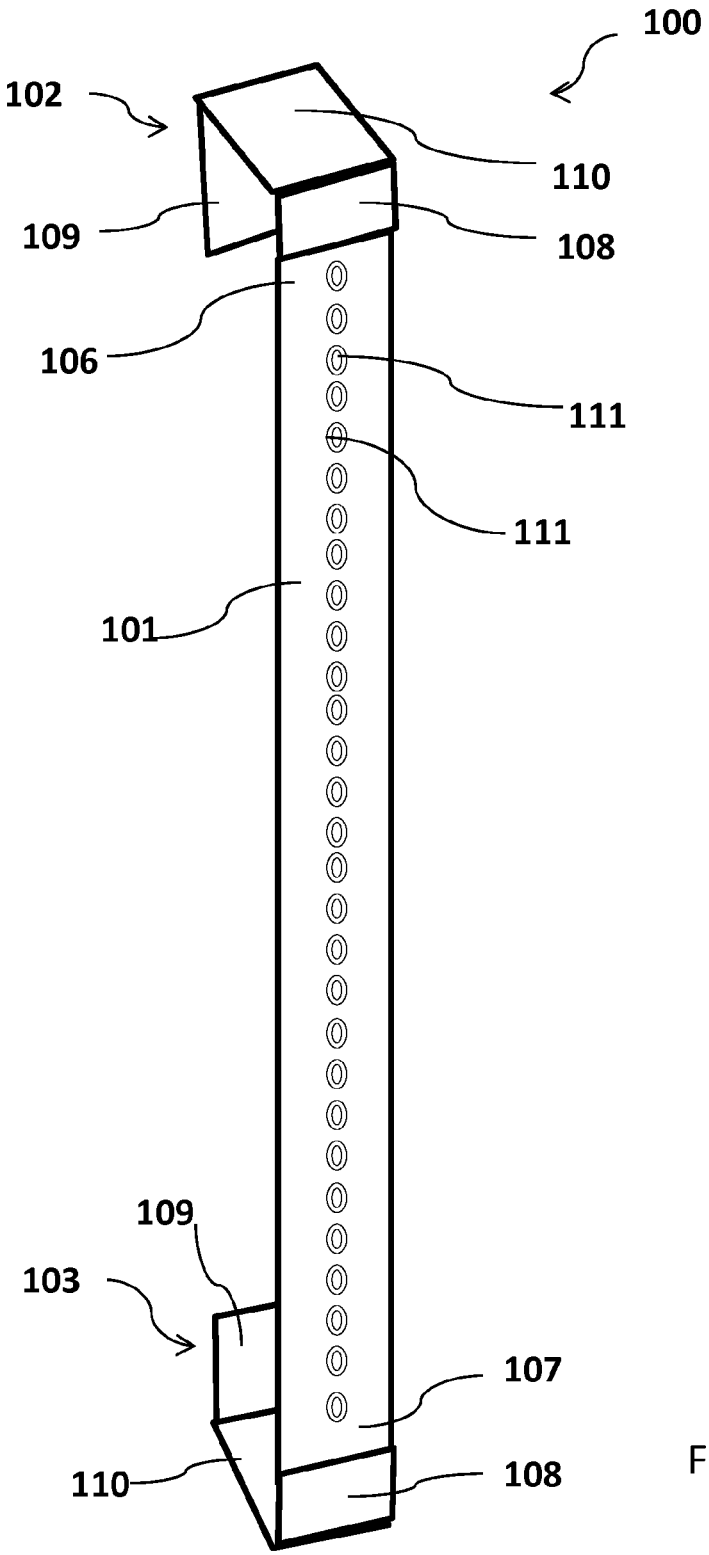
FIG. 2 is a perspective view of a strap with a top bracket and a bottom bracket.
Figure 3:
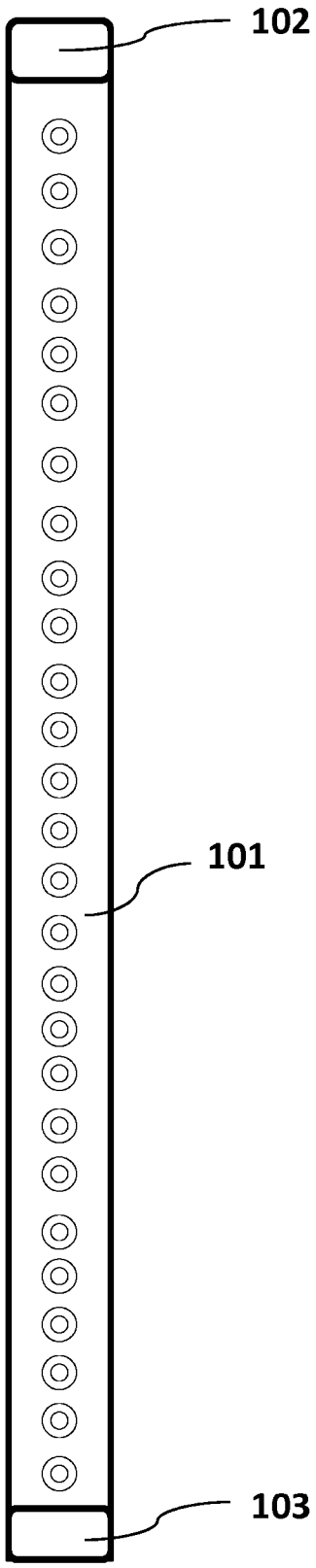
FIG. 3 is a front view of a strap with a top bracket and a bottom bracket

In order for the user to stretch a garment using the garment stretching apparatus 100, the user positions the top bracket 102 on the top edge of the upright and the bottom bracket 103 below the bottom edge of the upright so that the strap lays flat on the upright as shown in FIG. 4. The user then places each end of the wet garment, or the end aspects of the garment or fabric that the user is intending to stretch, into an opened clamp 104, 105 and in between the two flats 112,113. Once the garment is positioned between the two flats 112, 113 of each clamp 104, 105, the clamp mechanism 114 is folded upward and the garment is secured by the clamps 104,105. As shown in FIG. 1, the user chooses an aperture 111 for the top clamp 104 and inserts the hook 116 of the top clamp 104 into the aperture 111 selected; next, the user selects a lower aperture 111 based on the amount of stretching desired and inserts the hook 116 of the bottom clamp 105 into the chosen aperture 111 in a reverse direction. As noted above, the elastic device 115 provides the needed extension to facilitate the stretching during the drying process. Once the desired stretching is achieved, the user removes the clamps 104, 105 from the apertures 111, next the strap 101 with brackets 102, 103 is removed from the upright and the garment stretching apparatus 100 is stored for the next use.

When describing elements or features and/or embodiments thereof, the articles "a", "an", "the", "each", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in limiting sense.

It is further to be understood that the processes or steps described herein are not to be construed as necessarily requiring their performance in the particular order discussed or illustrated. It is also understood that additional or alternative processes or steps may be employed.

What is claimed is:

1. A garment stretching apparatus comprising:

a strap having a first end and a second end;

a first bracket connected to the first end of the strap wherein the first bracket comprising a first side, a second side, and a third side extending from the first side to the second side thereby forming a u-shaped gap;

a second bracket connected to the second end of the strap wherein the second bracket comprising a first side, a second side, and a third side extending from the first side to the second side thereby forming a u-shaped gap;

a first hanger comprising a first hook and a first pair of flats configured to hold a first portion of a garment wherein the first hanger is positioned such that the first hook is above the first pair of flats; and a second hanger comprising a second hook and a second pair of flats configured to hold a second portion of the garment, wherein the first hanger is positioned above the second hanger; and wherein the second hanger is positioned such that the second hook is below the second pair of flats thereby allowing a garment attached to the first pair of flats and the second pair of flats to extend from the first pair of flats to the second pair of flats.

2. A garment stretching apparatus as in claim 1 wherein each hanger is configured such that the distance between the hook and the pair of flats is adjustable.

3. A method of stretching a garment using a garment stretching apparatus comprising a strap having a first end and a second end; a first bracket connected to the first end of the strap wherein the first bracket comprising a first side, a second side, and a third side extending from the first side to the second side thereby forming a u-shaped gap; a second bracket connected to the second end of the strap wherein the second bracket comprising a first side, a second side, and a third side extending from the first side to the second side thereby forming a u-shaped gap; a first hanger comprising a first hook and a first pair of flats configured to hold a first portion of a garment; and a second hanger comprising a second hook and a second pair of flats configured to hold a second portion of the garment, the method comprising:

placing the first bracket on a top of a door whereby the third side of the first bracket rest on top of the door and a portion of the door is positioned in the u-shape gap of the first bracket;

placing the second bracket on a bottom of a door whereby the third side of the second bracket rest against the bottom of the door and a portion of the door is positioned in the u-shape gap of the second bracket and whereby the strap extends vertically from the first bracket to the second bracket;

securing a first portion of a garment between the first pair of flats;

attaching the first hook to the garment stretching apparatus at a first position whereby the first hook is above the first pair of flats;

securing a second portion of the garment between the second pair of flats; and attaching and orientating the second hook to the garment stretching apparatus at a second position whereby the first position is higher than the second position and whereby the second hook is below the second pair of flats thereby allowing the garment attached to the first pair of flats and the second pair of flats to extend vertically from the first pair of flats to the second pair of flats.

* * * * *